US009637336B2

(12) United States Patent
Mizuno

(10) Patent No.: US 9,637,336 B2
(45) Date of Patent: May 2, 2017

(54) SHEET CONVEYING APPARATUS AND IMAGE FORMING APPARATUS

(71) Applicant: CANON KABUSHIKI KAISHA, Tokyo (JP)

(72) Inventor: Tatsubumi Mizuno, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 15 days.

(21) Appl. No.: 14/600,313

(22) Filed: Jan. 20, 2015

(65) Prior Publication Data

US 2015/0217955 A1 Aug. 6, 2015

(30) Foreign Application Priority Data

Jan. 31, 2014 (JP) ..... 2014-016881

(51) Int. Cl.

| | |
|---|---|
| ***B65H 7/02*** | (2006.01) |
| ***B65H 5/06*** | (2006.01) |
| ***B65H 85/00*** | (2006.01) |
| ***B65H 7/14*** | (2006.01) |
| ***B65H 9/00*** | (2006.01) |

(52) U.S. Cl.

CPC ..... *B65H 5/062* (2013.01); *B65H 7/14* (2013.01); *B65H 9/004* (2013.01); *B65H 85/00* (2013.01); *B65H 2403/512* (2013.01); *B65H 2553/612* (2013.01); *B65H 2701/1313* (2013.01)

(58) Field of Classification Search

CPC .. B65H 7/02; B65H 2407/30; B65H 2511/16; B65H 2511/50; B65H 2513/512; B65H 5/00; B65H 7/00; B65H 7/20; B65H 2553/00

See application file for complete search history.

(56) References Cited

U.S. PATENT DOCUMENTS

| | | | | |
|---|---|---|---|---|
| 6,947,679 | B2 | 9/2005 | Kato et al. | |
| 7,980,556 | B2 | 7/2011 | Mizuno | |
| 8,172,227 | B2 | 5/2012 | Furusawa et al. | |
| 8,342,519 | B2 * | 1/2013 | Watanabe | B65H 9/004 271/243 |
| 8,864,125 | B2 | 10/2014 | Mizuno | |
| 2011/0089629 | A1 | 4/2011 | Furusawa et al. | |
| 2014/0175737 | A1 * | 6/2014 | Muramatsu | B65H 9/002 271/229 |

FOREIGN PATENT DOCUMENTS

| | | | |
|---|---|---|---|
| EP | 2492225 | A1 | 8/2012 |
| JP | 06-94444 | A | 4/1994 |
| JP | 5474081 | B2 | 4/2014 |
| WO | 2011-048669 | A1 | 4/2011 |

* cited by examiner

*Primary Examiner* — Thomas Morrison

(74) *Attorney, Agent, or Firm* — Fitzpatrick, Cella, Harper & Scinto

(57) ABSTRACT

To provide a sheet conveying apparatus and an image forming apparatus that can accurately detect a position of a rear end of a sheet regardless of rigidity of the sheet. A rotation axis is positioned to one of a plurality of stop positions by a positioning mechanism, an applied force of a torsion coil spring provided between the rotation axis and a first sensor flag, and an applied force of a torsion coil spring provided between the rotation axis and a second sensor flag are made smaller than an applied force of a pressing spring provided in the positioning mechanism.

12 Claims, 12 Drawing Sheets

SHEET CONVEYING APPARATUS AND IMAGE FORMING APPARATUS

BACKGROUND OF THE INVENTION

Field of the Invention

The present invention relates to a sheet conveying apparatus and an image forming apparatus, and especially relates to a configuration of a sheet detector that detects passage of a rear end of a sheet.

Description of the Related Art

Conventionally, an image forming apparatus such as a copying machine, a printer, or a facsimile machine, includes a sheet conveying apparatus that conveys a sheet. With the sheet conveying apparatus, the image forming apparatus conveys the sheet to an image forming portion, transfers a toner image formed on a photosensitive drum to the sheet, conveys the sheet on which the toner image is transferred to a fixing portion, and then conveys the sheet to a sheet discharging portion. In recent years, the image forming apparatus is required for further improvement of productivity, that is, improvement of the number of image formed sheets per unit time. Therefore, speeding up of a sheet conveying speed and reduction of an interval from a rear end of a sheet to a tip of a subsequent sheet of continuously conveyed sheets (hereinafter, referred to as sheet interval) have been achieved.

By the way, when the sheet is conveyed in the conventional sheet conveying apparatus, a switching operation of various switching portions and a switching operation of a rotating direction of a sheet conveying portion are performed based on detection of the rear end of the sheet. For the detection of the rear end of the sheet, a sheet detector that detects the rear end of the sheet is provided on a sheet conveying path.

Here, as the sheet detector, there is one that includes a sensor flag (see Japanese Patent Laid-Open No. 6-94444). The sensor flag performs reciprocating motion between a standby position and an allowable position where passage of the sheet is allowed, by being pressed by the sheet every time the sheet passes through. However, the sheet detector having the configuration of allowing the sensor flag to perform reciprocating motion and detecting the passage of the sheet cannot detect the passage of the sheet if the sheet interval is short, because the sensor flag requires a certain time to return from the allowable position to the standby position.

Therefore, a sheet detecting apparatus is disclosed (see U.S. Patent Application Publication No. 2011/089629 A1), which includes a sensor flag including a plurality of abutting pieces that abuts on the sheet, in the same direction to a conveying direction of the sheet in a rotatable manner so that the passage of the sheet can be detected even if the sheet interval is short. In this sheet detecting apparatus, when the sheet is conveyed, one of the plurality of abutting pieces is pressed by the sheet, and the sensor flag is rotated in the sheet conveying direction. Then, when the rear end of the sheet passes through the sensor flag, other abutting pieces are sequentially moved to the standby position where the abutting piece abuts on a subsequently conveyed sheet. Accordingly, the sheet detecting apparatus can detect the passage of the rear end of a preceding sheet, and can prepare for detection of a tip of a subsequently conveyed sheet. Therefore, the sheet detecting apparatus can support speeding up of the sheet conveying speed and a shorter sheet interval than before.

By the way, there is a case in which the conventional sheet conveying apparatus conveys a sheet having extremely low rigidity, such as a thin paper having a basis weight of less than 60 g/m$^2$. In this case, when the rear end of the preceding sheet passes through the sensor flag, the abutting piece of the sensor flag may sometimes be moved to the standby position while pushing the rear end of the sheet aside. In this case, timing when the sensor flag is moved to the standby position becomes earlier than timing of a case of a sheet having higher rigidity, and timing of the detection of the rear end of the sheet becomes earlier. As described above, when there is difference in the rigidity of the conveyed sheets, a difference is caused in the timing of the detection of the rear end of the sheet.

Here, a detection signal for detecting the rear end of the sheet in control of conveying the sheet is used as a reference for the switching operation of various switching portions and the switching operation of a rotating direction of a conveying portion. Therefore, if the difference is caused in the timing of the detection of the rear end of the sheet depending on the difference of the rigidity of the sheet, the switching timing needs to be set with a temporal margin in expectation of detection variation, and this may hinder improvement of the productivity.

When the rear end of the sheet passes through, the sensor flag is moved to the standby position by a positioning mechanism that includes a spring and a cam. Therefore, if the spring for moving the sensor flag is changed to a spring having a small spring force, occurrence of the difference in the timing of the detection of the rear end of the sheet depending on the difference of the rigidity of the sheet can be prevented. However, when the spring having a small spring force is used, the spring cannot stop the sensor flag that continues the rotation by inertia, at the standby position.

Therefore, the present invention has been made in view of the foregoing, and it is desirable to provide a sheet conveying apparatus and an image forming apparatus that can accurately detect a position of a rear end of a sheet regardless of rigidity of the sheet.

SUMMARY OF THE INVENTION

The present invention includes: in a sheet conveying apparatus, a sheet conveying portion that conveys a sheet; a sheet conveying path that the sheet conveyed by the sheet conveying portion passes through; and a sheet detector that detects that a rear end of the sheet has passed through the sheet conveying path. The sheet detector includes a rotation axis provided along a width direction perpendicular to a sheet conveying direction; a first rotating member and a second rotating member having lever portions as operating portions protruding into the sheet conveying path formed on peripheral portions, and rotatably supported by the rotation axis; a detector that detects that the rear end of the sheet has passed through the sheet conveying path according to positions of the first rotating member and the second rotating member; a positioning portion that positions the rotation axis to one of a plurality of stop positions by an applied force; a first force applying portion provided between the first rotating member and the rotation axis, and including an applied force smaller than the applied force of the positioning portion; and a second force applying portion provided between the second rotating member and the rotation axis, and applying a force to the second rotating member between the second force applying portion and the rotation axis, with an applied force smaller than the applied force of the positioning portion, such that a phase of the second rotating member with respect to the rotation axis differs from a phase of the first rotating member.

According to the present invention, the applied forces of the first and second force applying portions provided between the rotation axis and the first and second rotating members are made smaller than the applied force of the positioning portion that performs positioning of the rotation axis, whereby the position of the rear end of the sheet can be accurately detected regardless of the rigidity of the sheet.

Further features of the present invention will become apparent from the following description of exemplary embodiments with reference to the attached drawings.

DESCRIPTION OF THE EMBODIMENTS

Figure 1:
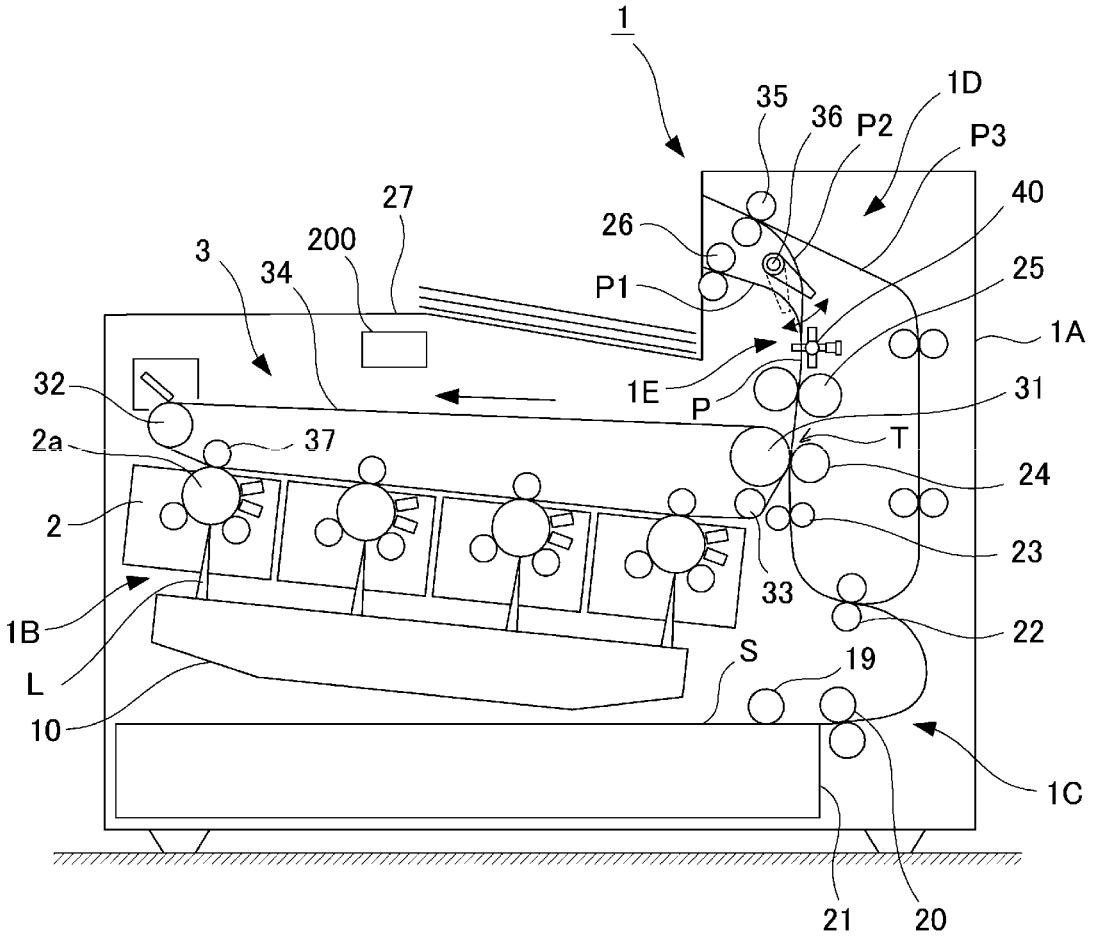
FIG. 1 is a diagram illustrating a schematic configuration of a full color laser printer that is an example of an image forming apparatus including a sheet conveying apparatus according to a first embodiment of the present invention.

Hereinafter, embodiments for implementing the present invention will be described in detail using the drawings. FIG. 1 is a diagram illustrating a schematic configuration of a full color laser printer that is an example of an image forming apparatus including a sheet conveying apparatus according to a first embodiment of the present invention. FIG. 1 illustrates a full color laser beam printer 1, a full color laser beam printer main body (hereinafter, referred to as printer main body) 1A, an image forming portion 1B that forms a toner image, a sheet feeding apparatus 1C, and a re-conveying portion 1D. A sheet conveying apparatus 1E conveys a sheet fed by the sheet feeding apparatus 1C to the image forming portion 1B, and conveys the sheet on which an image is formed by the image forming portion 1B to a fixing portion 25 and the re-conveying portion 1D.

The image forming portion 1B includes a scanner unit 10, four process cartridges 2 that form the toner image with four colors: yellow, magenta, cyan, and black, and an intermediate transfer unit 3 arranged above the process cartridges 2. Each of the process cartridges 2 includes a photosensitive drum 2*a* that is an image bearing member that forms the toner image.

The intermediate transfer unit 3 includes an intermediate transfer belt 34 wound around a driving roller 31, a tension roller 32, and a driven roller 33. Further, the intermediate transfer unit 3 includes a primary transfer roller 37 provided inside the intermediate transfer belt 34, and abutting on the intermediate transfer belt 34 at a position facing the photosensitive drum 2*a*. Here, the intermediate transfer belt 34 includes a film-like member, arranged to come in contact with the photosensitive drums 2*a*, and rotated in the arrow direction (counterclockwise direction) by the driving roller 31 driven by a driving portion (not illustrated).

A positive polarity transfer bias is applied to the intermediate transfer belt 34 by the primary transfer roller 37, so that toner images having negative polarity on the photosensitive drums are sequentially multi-transferred to the intermediate transfer belt 34. Accordingly, a full color image is formed on the intermediate transfer belt. Note that a secondary transfer roller 24 is provided at a position facing the driving roller 31 of the intermediate transfer unit 3. The secondary transfer roller 24 includes a secondary transfer portion T that transfers the full color image formed on the intermediate transfer belt to a sheet S.

The fixing portion 25 is arranged above the secondary transfer portion T, and a pair of discharge rollers 26 and a switching member 36 are arranged above the fixing portion 25. The re-conveying portion 1D includes a pair of switchback rollers 35 arranged above the fixing portion 25. The pair of switchback rollers 35 can perform normal and reverse rotation. The pair of discharge rollers 26 discharges the sheet on which an image is fixed to an outside of the apparatus. The switching member 36 guides the sheet on which the image is fixed by the fixing portion 25 to either the pair of discharge rollers 26 or the pair of switchback rollers 35. Note that FIG. 1 illustrates a controller 200 that controls an image forming operation of the image forming portion 1B, a switching operation of a conveying path by the switching member 36 described below, and a normal and reverse rotation operation of the pair of switchback rollers 35.

Next, an image forming operation of the full color laser beam printer 1 configured as described above will be described. When the image forming operation is started, first, the scanner unit 10 irradiates surfaces of the photosensitive drums 2*a* with a laser light L based on image information from a personal computer or the like (not illustrated), and sequentially exposes the surfaces of the photosensitive drums 2*a* that are uniformly charged to predetermined polarization/potential to form electrostatic latent images on the photosensitive drum. Following that, the full color laser beam printer 1 develops and visualizes the electrostatic latent images with toners, and then sequentially transfers the toner images on the photosensitive drums to the intermediate transfer belt 34 by the primary transfer bias applied to the primary transfer roller 37, thereby to form a full color toner image on the intermediate transfer belt.

The sheet feeding apparatus 1C feeds the sheets S stored in a sheet feeding cassette 21 with a pickup roller 19, in parallel with the toner image forming operation. The sheets S are separated sheet by sheet by a pair of separation rollers 20, and are then conveyed by conveying rollers 22 to a pair of registration rollers 23. At this time, the pair of registration rollers 23 is being stopped and the sheet S abuts on a nip portion of the pair of registration rollers 23 in a stopped state, and a loop is formed in the sheet S, whereby skew feeding of the sheet S is corrected.

After the skew feeding of the sheet S is corrected, the pair of registration rollers 23 is driven at timing to adjust positions of the full color toner image on the intermediate transfer belt and of the sheet S, in the secondary transfer portion T. Accordingly, the sheet S is conveyed to the secondary transfer portion T, and the full color toner image is collectively transferred on the sheet by a secondary transfer bias applied to the secondary transfer roller 24, in the secondary transfer portion T.

Next, the sheet S on which the full color toner image is transferred is conveyed to the fixing portion 25 and is applied heat and pressure in the fixing portion 25, and toners of respective colors are melted and mixed, and fixed on the sheet S as a full color image. Following that, in a case of simplex printing (simplex image formation) of forming an image only on one side of the sheet, the sheet S on which the image is fixed is discharged to a sheet discharge tray 27 by the pair of discharge rollers 26 provided at a downstream side of the fixing portion 25 in the sheet conveying direction.

Meanwhile, in a case of duplex printing of forming imaged on both sides of the sheet S, the switching member 36 is rotated in a clockwise direction by a solenoid or the like (not illustrated), the sheet conveying path is changed from a path P1 at the side of the pair of sheet discharge rollers to a path P2 at the side of the re-conveying portion. Accordingly, the sheet S with an image formed on one side is guided to the pair of switchback rollers 35, and is then conveyed to a duplex conveying path P3 by switchback of the pair of switchback rollers 35. Then, the sheet S passes through the duplex conveying path P3 again and is conveyed to the image forming portion 1B, and an image is formed on a back side.

By the way, as illustrated in FIG. 1, a sheet detecting apparatus 40 is arranged on a sheet conveying path P between the fixing portion 25 and the switching member 36, the sheet conveying path P configuring the sheet conveying portion that conveys the sheet. The sheet detecting apparatus 40 is a sheet detector that detects passage of the sheet. The controller 200 controls timing of switching of the conveying path by the switching member 36, and of switching of the normal and reverse rotation of the pair of switchback rollers 35, based on a signal of the detection of the rear end of the sheet from the sheet detecting apparatus 40.

Figure 2:
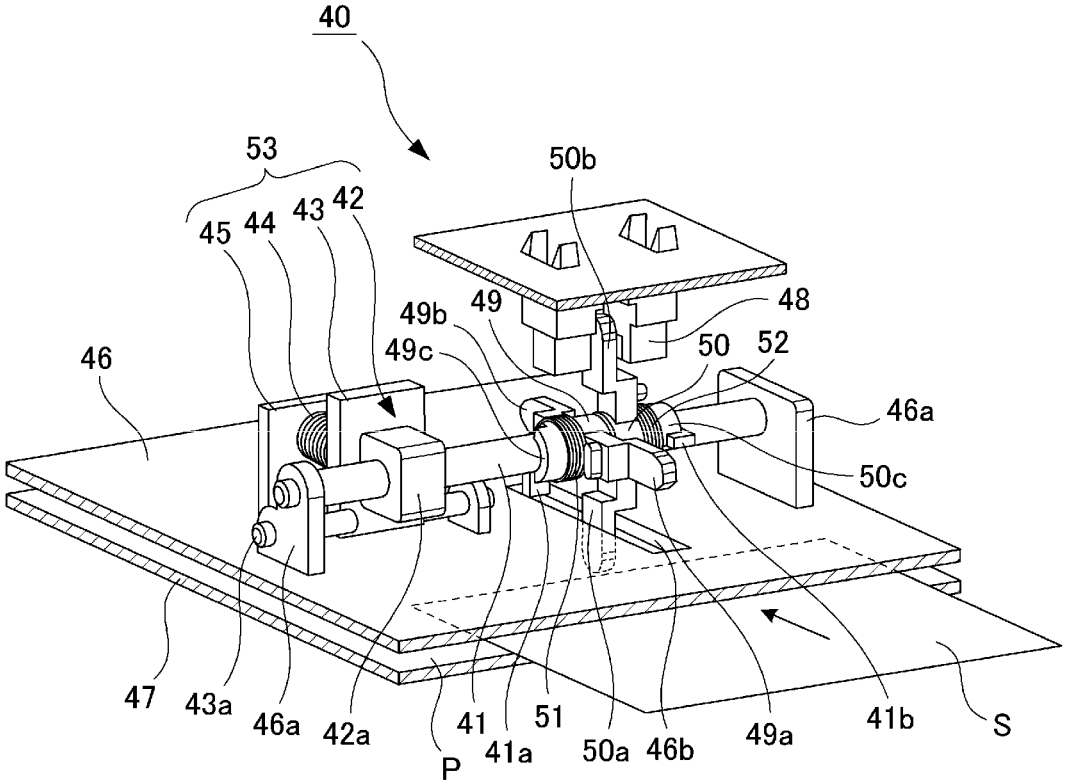
FIG. 2 is a diagram describing a configuration of a sheet detecting apparatus provided in the sheet conveying apparatus.

FIG. 2 is a perspective view describing a configuration of the sheet detecting apparatus 40. FIG. 2 illustrates a first sensor flag 49 and a second sensor flag 50. The first sensor flag 49 and the second sensor flag 50 are provided in a freely rotatable manner to a rotation axis 41 provided along a width direction perpendicular to the sheet conveying direction.

The first sensor flag 49 as a first rotating member includes lever portions (first sheet abutting portions) 49*a* and 49*b* as two operating portions formed symmetrically to a peripheral surface. The second sensor flag 50 as a second rotating member includes two lever portions (second sheet abutting portions) 50*a* and 50*b* formed symmetrically to a peripheral surface. Further, the first and second sensor flags 49 and 50 are attached to the rotation axis 41 such that phases of the lever portions 49*a* and 49*b* of the first sensor flag 49 and the lever portions 50*a* and 50*b* of the second sensor flag 50 are shifted by 90°. The lever portions 49*a* and 49*b* are pressed to the conveyed sheet, so that the first sensor flag 49 is rotated. The lever portions 50*a* and 50*b* are pressed to the conveyed sheet, so that the second sensor flag 50 is rotated.

A first conveying guide 46 and a second conveying guide 47 form the sheet conveying path P between the fixing portion 25 and the switching member 36. Further, bearings 46*a* that axially support the rotation axis 41 in a freely rotatable manner are provided at both sides of the first conveying guide 46 in a width direction in a hanging manner. Further, a slit 46*b* extending in the sheet conveying direction is formed in a position of the first conveying guide 46 and the second conveying guide 47, the position facing the first and second sensor flags 49 and 50.

By formation of such a slit 46*b*, the plurality of lever portions 49*a* and 49*b* (hereinafter, referred to as first lever portions) formed on the peripheral surface of the first sensor flag 49 can enter an inside of the sheet conveying path P. Also, the plurality of lever portions 50*a* and 50*b* (hereinafter, referred to as second lever portions) formed on the peripheral surface of the second sensor flag 50 can enter the inside of the sheet conveying path P.

An optical sensor 48 is a detector that detects that the rear end of the sheet has passed through the sheet conveying path P, and is turned ON/OFF by shielding/transmission of light by the first lever portions 49*a* and 49*b* and the second lever portions 50*a* and 50*b*. Here, when one lever portion of the first lever portions 49*a* and 49*b*, or one lever portion of the second lever portions 50*a* and 50*b* enters the inside of the sheet conveying path P, the other lever portion at the opposite side to the lever portion that has entered the inside of the sheet conveying path P causes the optical sensor 48 to be in a light shielded state. That is, when one lever portion of the first lever portions 49*a* and 49*b*, or of the second lever portions 50*a* and 50*b* enters the inside of the sheet conveying path P, the lever portion at the opposite side causes the optical sensor 48 to be in the light shielded state.

The optical sensor 48 is connected to the controller 200, and when the optical sensor 48 becomes in the light shielded state, the controller 200 determines that the sheet has not entered the inside of the sheet conveying path P, based on a signal that indicates a state of the optical sensor 48. When the sheet has entered the inside of the sheet conveying path P, the lever portion that entered the inside of the sheet conveying path P is pressed by the sheet, and the first and second sensor flags 49 and 50 are rotated, so that the light shielded state of the optical sensor 48 by the lever portion is cancelled. Accordingly, the controller 200 determines that the sheet has entered the inside of the sheet conveying path P.

A positioning mechanism 53 is a positioning portion that performs positioning of the rotation axis 41 in a rotating direction in each ¼ round (90°). The positioning mechanism 53 includes a rotating cam 42 attached to the rotation axis 41, a pressing member 43 supported by the bearings 46*a* through a rotation central axis 43*a* in a freely moving forward and backward manner, and a pressing spring 44 that is a cam force applying portion that applies a force to the pressing member 43 in a direction of abutting on the rotating cam 42.

Here, four planar abutting surfaces 42*a* are formed on the rotating cam 42 along the rotating direction, and one of the four abutting surfaces 42*a* comes in surface contact with the pressing member 43, so that the rotating cam 42 is positioned to one of four (a plurality of) stop positions. The rotating cam 42 is positioned in this way, so that the rotation axis 41 is stably positioned in a rotated state by 90° corresponding to the abutting surface 42*a* that is in surface contact with the pressing member 43. Note that one lever portion of the first lever portions 49*a* and 49*b*, or one lever portion of the second lever portions 50*a* and 50*b* enters the inside of the sheet conveying path P according to the phase of the rotation axis 41 of when being positioned.

Two butting portions (a first portion to be engaged and a second portion to be engaged) 41*a* and 41*b* protruding in a radial direction are provided on the rotation axis 41. The two butting portions 41*a* and 41*b* are integrally rotated with the rotation axis 41. An abutting portion (first engaging portion) 49*c* that is locked to the butting portion 41*a* that is the first portion to be engaged is provided on the first sensor flag 49. An abutting portion (second engaging portion) 50*c* that is locked to the butting portion 41*b* that is the second portion to be engaged is provided on the second sensor flag 50. The first sensor flag 49 is applied a force by a torsion coil spring 51 that is a first force applying portion provided between the first sensor flag 49 and the rotation axis 41, in a direction into which the abutting portion 49*c* is locked to the butting portion 41*a* of the rotation axis 41. Further, the second sensor flag 50 is applied a force by a torsion coil spring 52 that is a second force applying portion provided between the second sensor flag 50 and the rotation axis 41, in a direction into which the abutting portion 50*c* is locked to the butting portion 41*b* that is a second locking portion.

Here, the applied forces by the torsion coil springs 51 and 52 are set to a minimum necessary very weak pressure for allowing the abutting portions 49*c* and 50*c* of the first and second sensor flags 49 and 50 to abut on the butting portions 41*a* and 41*b* against own weights and sliding resistances between the first and second sensor flags 49 and 50, and the rotation axis 41. Further, the applied forces by the torsion coil springs 51 and 52 are set smaller than the applied force by the pressing spring 44.

The butting portions 41*a* and 41*b* of the rotation axis 41 are provided at positions where phases are shifted by 90° in a circumference direction. Accordingly, the first and second sensor flags 49 and 50 are pressed to the butting portions 41*a* and 41*b* of the rotation axis 41 by the torsion coil springs 51 and 52, and are held in attitudes where the phases are shifted by 90°, in the standby state in which no external force is applied from the sheet illustrated in FIG. 2.

Further, in the standby state, as illustrated in FIG. 2, one lever portion 50*a* of the second lever portions 50*a* and 50*b* protrudes into the inside of the sheet conveying path P through the slit 46*b*, and the other lever portion 50*b* is in a light shielding position where the lever portion 50*b* shields an optical path of the optical sensor 48 from a light emitting portion to a light receiving portion. The controller 200 detects that the sheet S is not passing through the sheet conveying path P because the optical sensor 48 is in the light shielded state.

Meanwhile, when the sheet S is passing through the sheet conveying path P, the protruding lever portion 50*a* is pressed by the sheet S, so that the second sensor flag 50 is rotated and the lever portion 50*b* is retracted from the optical path according to the rotation, and the optical sensor 48 becomes in a light transmitted state. The controller 200 then detects that the sheet S is passing through the sheet conveying path P when the optical sensor 48 becomes in the light transmitted state.

Figure 3A:
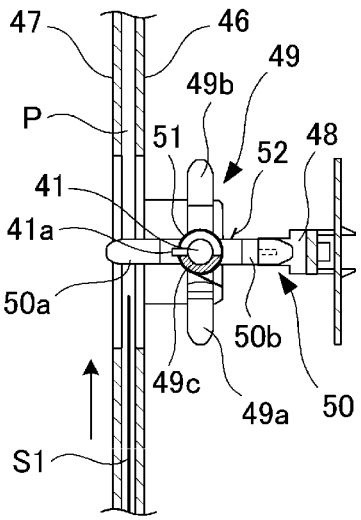
FIGS. 3A to 3D are first diagrams describing a sheet detecting operation of the sheet detecting apparatus.
Figure 3B:
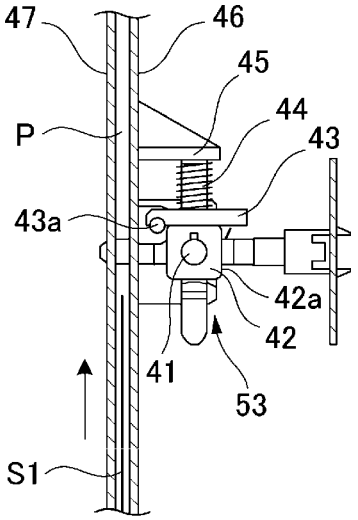

Next, a sheet detecting operation of the sheet detecting apparatus 40 having the above configuration will be described. FIGS. 3A and 3B illustrate a state in which the sheet detecting apparatus 40 is in the standby state. At this time, as illustrated in FIG. 3A, the lever portion 50*a* of the second sensor flag 50 protrudes into the sheet conveying path P, and is positioned in the standby position in which the lever portion 50*a* waits for the passage of a conveyed sheet S1. At this time, the other lever portion 50*b* is in the position of shielding the optical path of the optical sensor 48, and thus the optical sensor 48 is in the light shielded state. Accordingly, the controller 200 detects that the sheet S1 is not passing through the sheet conveying path P. Further, at this time, as illustrated in FIG. 3B, the rotation axis 41 is stably positioned without being rotated because one of the four abutting surfaces 42*a* of the rotating cam 42 is in surface contact with the pressing member 43 by the positioning mechanism 53.

Figure 3C:
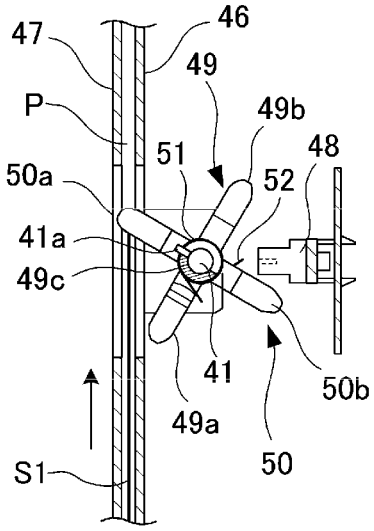

FIG. 3C illustrates a state in which conveyance of the sheet S1 is advanced from the state of FIG. 3A, and at this time, the lever portion 50*a* of the second sensor flag 50, which protrudes into the sheet conveying path P, is pressed by a tip of the sheet S1. Here, when the lever portion 50*a* of the second sensor flag 50 is pressed, the second sensor flag 50 is rotated. Then, when the second sensor flag 50 is rotated, the rotation axis 41 in the state where the abutting portion 50*c* of the second sensor flag 50 illustrated in FIG. 2 is locked to the butting portion 41*b* is also rotated. At this time, the lever portion 50*b* of the sensor flag 50 is retracted from the optical path of the optical sensor 48, and becomes in the light transmitted state. Accordingly, the controller 200 detects that the tip of the sheet S1 has entered a passing state of pressing the lever portion 50*a* of the sensor flag 50.

Figure 3D:
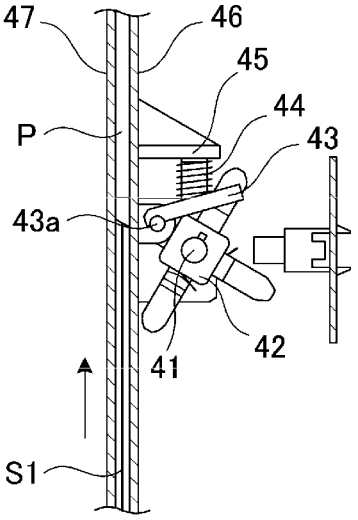

Further, when the rotation axis 41 is rotated, the first sensor flag 49 in the state where the abutting portion 49*c* of the first sensor flag 49 illustrated in FIG. 2 is locked to the butting portion 41*a* is integrally rotated with the rotation axis 41. Further, at this time, the rotating cam 42 is also integrally rotated with the rotation axis 41 against the applied force by the pressing spring 44. Note that, at this time, as illustrated in FIG. 3D, an abutting pressure by the pressing member 43 to the rotating cam 42 is directed toward a rotation center of the rotating cam 42. Therefore, in the state of FIG. 3D, the rotating cam 42 is in a neutral state.

Figure 4A:
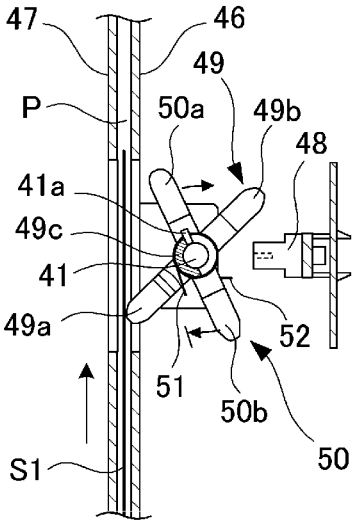
FIGS. 4A to 4D are second diagrams describing the sheet detecting operation of the sheet detecting apparatus.
Figure 4B:
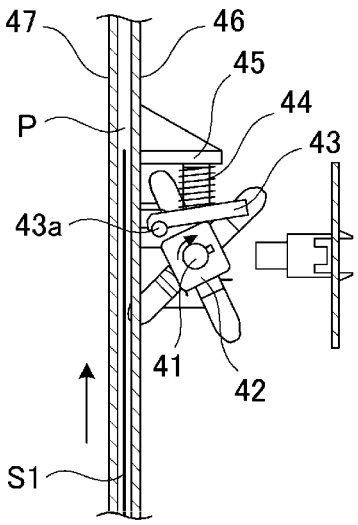

When the sheet S1 further progresses from the state of FIG. 3C, and the tip of the sheet S1 has passed through a tip end portion of the lever portion 50*a* of the sensor flag 50, as illustrated in FIG. 4A, the sensor flag 50 is further integrally rotated with the rotation axis 41. Then, when the rotating cam 42 is integrally rotated with the rotation axis 41 according to the rotation, the rotating cam 42 receives an applied force moment in a clockwise direction by the applied force of the pressing spring 44, which is received through the pressing member 43, as illustrated in FIG. 4B.

Figure 4C:
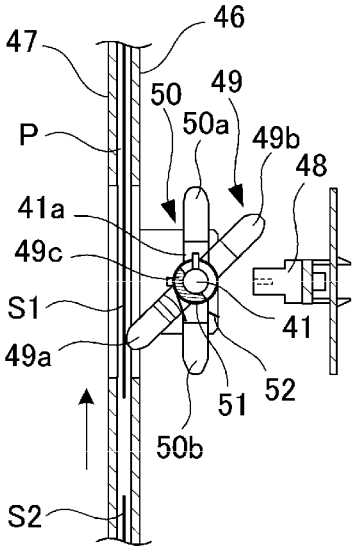
Figure 4D:
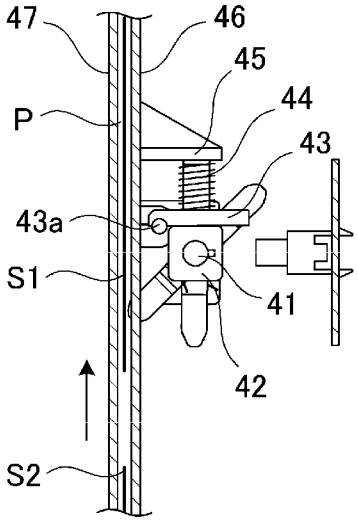

As described above, the rotating cam 42 is rotated, and the direction of the moment that acts on the rotating cam 42 is switched in the middle of the rotation, so that the rotation of the rotating cam 42 is stopped at the phase rotated by 90° from the standby state as illustrated in FIG. 4D according to the shape of the rotating cam 42. Then, the rotation axis 41 is rotated in the clockwise direction according to the rotation of the rotating cam 42, and when the rotation axis 41 is rotated, the first and second sensor flags 49 and 50 are applied the force by the torsion coil springs 51 and 52, and are rotated in the clockwise direction, following the rotation axis 41, as illustrated in FIG. 4A. Accordingly, the second sensor flag 50 is moved to a position where the lever portion 50*a* is retracted from the sheet conveying path P, illustrated in FIG. 4C.

Meanwhile, the first sensor flag 49 rotated following the rotation axis 41 is rotated up to a position where the lever portion 49*a* enters the sheet conveying path P, as illustrated in FIG. 4C, and abuts on a surface of the passing sheet S1. Here, as described above, the first sensor flag 49 is rotatable with respect to the rotation axis 41, and the applied force of the torsion coil spring 51 that applies a force in a locking direction is set smaller than the applied force of the pressing spring 44.

Therefore, after the lever portion 49*a* abuts on the surface of the sheet, the first sensor flag 49 does not follow the rotation axis 41, and is stopped in the state of abutting on the surface of the sheet S1 while allowing the abutting portion 49*c* to be away from the butting portion 41*a*, that is, compressing the torsion coil spring 51. That is, the rotation axis 41 is rotated with respect to the first sensor flag 49, so that the abutting portion (first engaging portion) 49*c* and the butting portion (first portion to be engaged) 41*a* become in a non-engaged state. Note that, at this time, the optical sensor 48 is continuously in the light transmitted state, and the controller 200 detects that the sheet S1 is continuously passing.

Figure 5A:
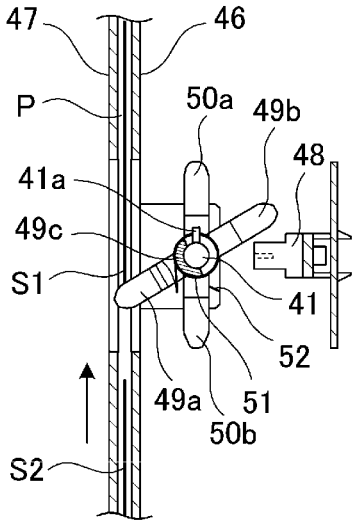
FIGS. 5A to 5D are third diagrams describing the sheet detecting operation of the sheet detecting apparatus.
Figure 5B:
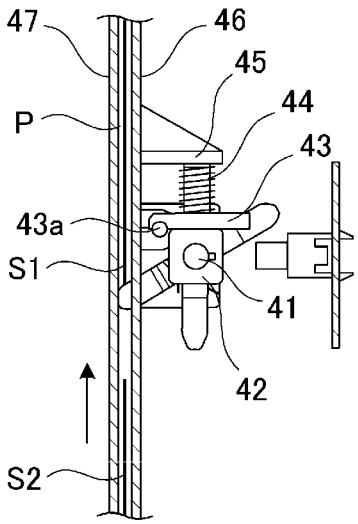

FIGS. 5A and 5B illustrate a state in which the conveyance of the sheet S1 is further advanced, and a state immediately after the rear end of the sheet S1 has passed through the tip end portion of the lever portion 49*a* of the first sensor flag 49. At this time, the first sensor flag 49 is applied a force in the direction of being locked to the butting portion 41*a* of the rotation axis 41, that is, in the clockwise direction, by the torsion coil spring 51 in a compressed state, and thus the first sensor flag 49 is rotated to follow the rear end of the sheet S1. Then, the first sensor flag 49 is rotated with respect to the rotation axis 41, so that the abutting portion (first engaging portion) 49*c* becomes in a state of being engaged with the butting portion (first portion to be engaged) 41*a*, and the first sensor flag 49 is stopped. Here, as described above, the spring pressure of the torsion coil spring 51 is set to a very small pressure, and thus even if the sheet S1 is a thin paper having very low rigidity, the first sensor flag 49 is not rotated while pushing away the sheet.

Figure 5C:
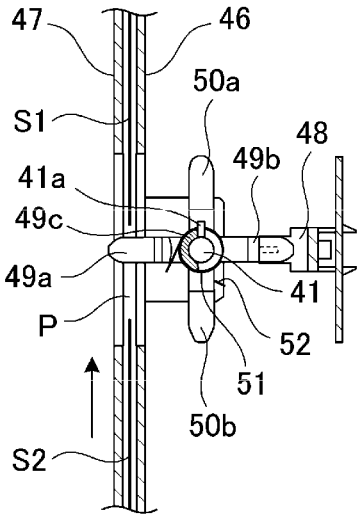
Figure 5D:
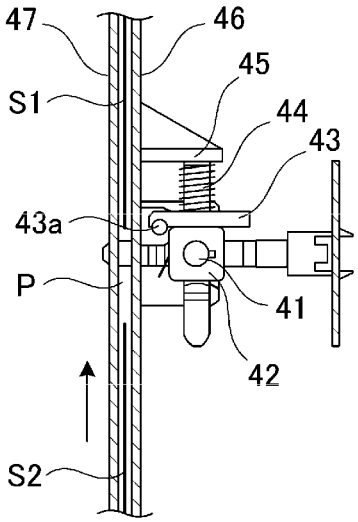

Therefore, the first sensor flag 49 is rotated following the rear end of the sheet S1 without pushing away the rear end of the sheet. Accordingly, as illustrated in FIG. 5C, the first sensor flag 49 is stopped at the position where the abutting portion 49*c* is locked to the butting portion 41*a* of the rotation axis 41, and according to the stop, the lever portion 49*a* of the first sensor flag 49 is moved to the standby position where a tip end of a next conveyed sheet S2 is detected. Further, at this time, as illustrated in FIG. 5D, the lever portion 49*b* of the first sensor flag 49 causes the optical sensor 48 to be in the light shielded state. Therefore, the controller 200 can detect that the rear end of the sheet S1 has passed through. Hereinafter, the controller 200 can repeat a similar operation with respect to continuously conveyed sheets, and can sequentially detect the passage of the rear ends of the sheets.

As described above, in the present embodiment, the applied forces of the torsion coil springs 51 and 52 provided between the rotation axis 41, and the first and second sensor flags 49 and 50 are made smaller than the applied force of the pressing spring 44 provided in the positioning mechanism 53. Accordingly, the force applied to the rear end of the sheet when the lever portions 49*a* and 49*b* of the first sensor flag 49 and the lever portions 50*a* and 50*b* of the second sensor flag 50 are moved toward the standby position can be made smaller than the applied force of the pressing spring 44.

The force applied to the rear end of the sheet is made small as described above, whereby the passage of the rear end of the sheet can be accurately detected even if the rigidity of the sheet is low. As a result, in the sheet conveyance control of the full color laser beam printer 1, an excessive temporal margin can be saved at the switching timing of the switching member 36 or the switching timing of the normal and reverse rotation of the pair of switchback rollers 35. In addition, the full color laser beam printer 1 according to the present embodiment can detect sheets with a small sheet interval in simplex continuous sheet passing, and can realize high productivity even in a case of forming a duplex image.

Next, a second embodiment of the present invention will be described. FIGS. 6A to 6D are diagrams describing a configuration of a sheet detecting apparatus provided in a sheet conveying apparatus according to the present embodiment. Note that, in FIGS. 6A to 6D, the same reference sign as FIGS. 3A to 3D described above indicates the same or corresponding portion.

Figure 6A:
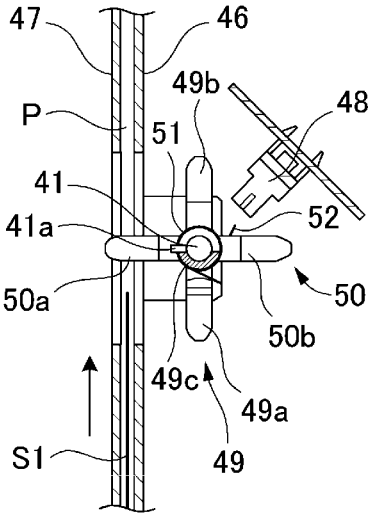
FIGS. 6A to 6D are diagrams describing a configuration of a sheet detecting apparatus provided in a sheet conveying apparatus according to a second embodiment of the present invention.
Figure 6B:
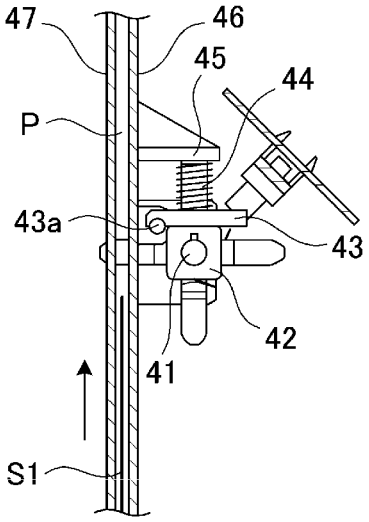

In the present embodiment, in the standby state illustrated in FIGS. 6A and 6B, an optical sensor 48 is arranged at a position where the optical sensor 48 does not detect a lever portion not protruding into a sheet conveying path P, of first lever portions 49*a* and 49*b* and second lever portions 50*a* and 50*b*. Accordingly, a controller 200 determines that a sheet S is passing through the sheet conveying path P when the optical sensor 48 is in a light shielded state, and determines that the sheet S is not passing through the sheet conveying path P when the optical sensor 48 is in a light transmitted state. That is, in the present embodiment, when the optical sensor 48 is in the light shielded state, the controller 200 determines that the sheet S is passing through the sheet conveying path P, and when the optical sensor 48 is in the light transmitted state, the controller 200 determines that the sheet S is not passing through the sheet conveying path P.

Figure 6C:
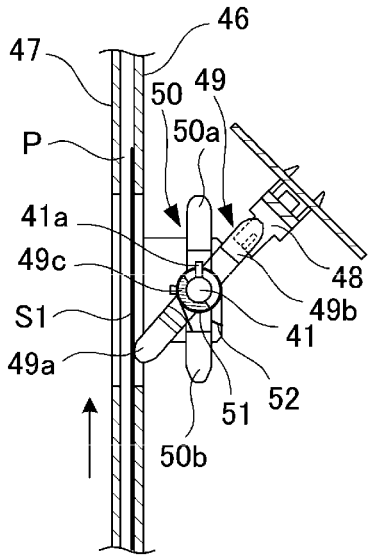
Figure 6D:
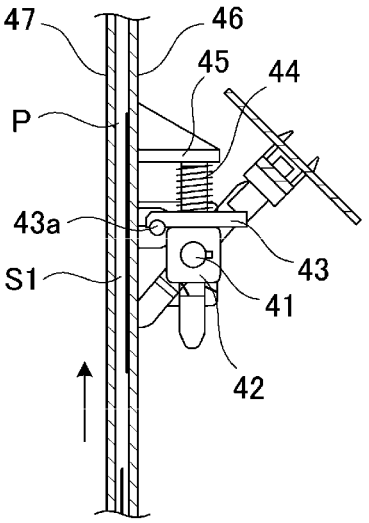

Further, when the sheet S1 progresses, the lever portion 50*a* is pressed by the sheet S1 and a second sensor flag 50 is rotated, as illustrated in FIG. 6C. Following that, a rotating cam 42 integrally rotated with a rotation axis 41 is stopped at a phase rotated by 90° from a standby state, as illustrated in FIG. 6D. At this time, the second sensor flag 50 is integrally rotated with the rotation axis 41, and the lever portion 50*a* is retracted from the sheet conveying path P.

Meanwhile, when a first sensor flag 49 rotated following the rotation axis 41 is rotated up to a position where the lever portion 49*a* enters the sheet conveying path P, as illustrated in FIG. 6C, the first sensor flag 49 abuts on a surface of the passing sheet S1. Here, as described above, the first sensor flag 49 is rotatable with respect to the rotation axis 41, and a spring pressure of a torsion coil spring 51 that applies a force in a locking direction is set to very small. Therefore, after the lever portion 49*a* abuts on the surface of the sheet, the first sensor flag 49 does not follow the rotation axis 41, and is stopped in a state of abutting on the surface of the sheet S1 while causing an abutting portion 49*c* to be away from a butting portion 41*a*, that is, compressing the torsion coil spring 51.

Note that, in the present embodiment, when the first sensor flag 49 is being stopped in the state of abutting on the surface of the sheet S1, the other lever portion 49*b* is in a light shielding position of shielding an optical path of the optical sensor 48 from a light emitting portion to a light receiving portion. Then, the controller 200 detects that the lever portion 49*a* is in an abutting state with the passing sheet S, that is, the sheet S is a state of passing through the sheet conveying path P, because the optical sensor 48 is in the light shielded state.

Figure 7A:
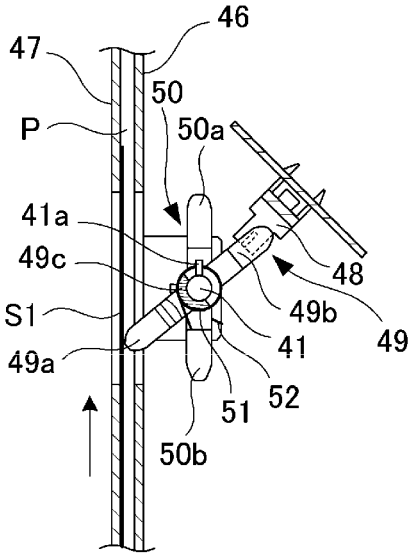
FIGS. 7A to 7B are diagrams describing a sheet detecting operation of the sheet detecting apparatus.
Figure 7B:
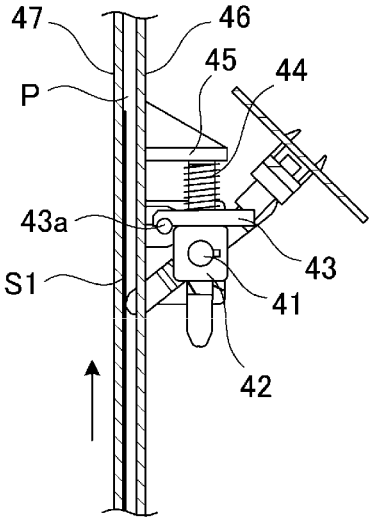

Here, when the sheet S1 passes through the sheet conveying path P, there are cases where the sheet S1 is conveyed closer to a second conveying guide 47 as illustrated in FIGS. 7A and 7B, and where the sheet S1 is conveyed closer to a first conveying guide 46, as illustrated in FIGS. 6C and 6D described above. Therefore, in the present embodiment, the width of the sheet conveying path P and the widths of the first and second sensor flags 49 and 50 are set such that the optical sensor 48 is caused to be in the light shielded state even if the state of the sheet passing through the sheet conveying path P is either in the state of FIGS. 6A to 6D or in the state of FIGS. 7A to 7D.

By the way, generally, if the optical sensor 48 cannot detect an output (signal) in the light transmitted state, the optical sensor 48 is determined as failure. In the present embodiment, as described above, the optical sensor 48 is in the light transmitted state when in the standby state. Accordingly, the failure of the optical sensor 48 can be detected before a sheet is conveyed. That is, like the present embodiment, the optical sensor 48 is in the light transmitted state when in the standby state, whereby presence of the failure of the optical sensor 48 can be detected before a sheet is conveyed, according to presence of the output (signal) of the optical sensor 48.

Figure 8:
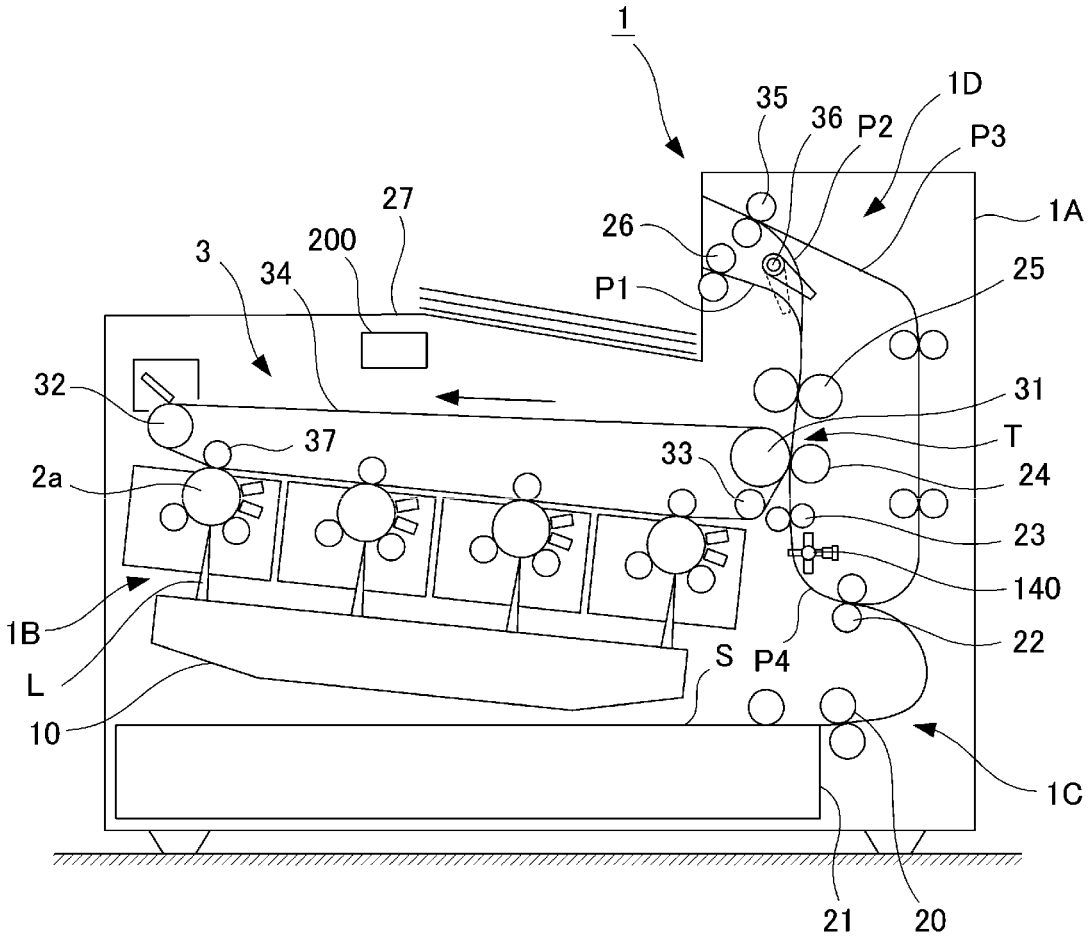
FIG. 8 is a diagram illustrating a schematic configuration of a full color laser printer that is an example of an image forming apparatus including a sheet conveying apparatus according to a third embodiment of the present invention.

Next, a third embodiment of the present invention will be described. FIG. 8 is a diagram illustrating a schematic configuration of a full color laser printer that is an example of an image forming apparatus including a sheet conveying apparatus according to the present embodiment. Note that, in FIG. 8, the same reference sign as FIG. 1 indicates the same or corresponding portion.

Figure 9:
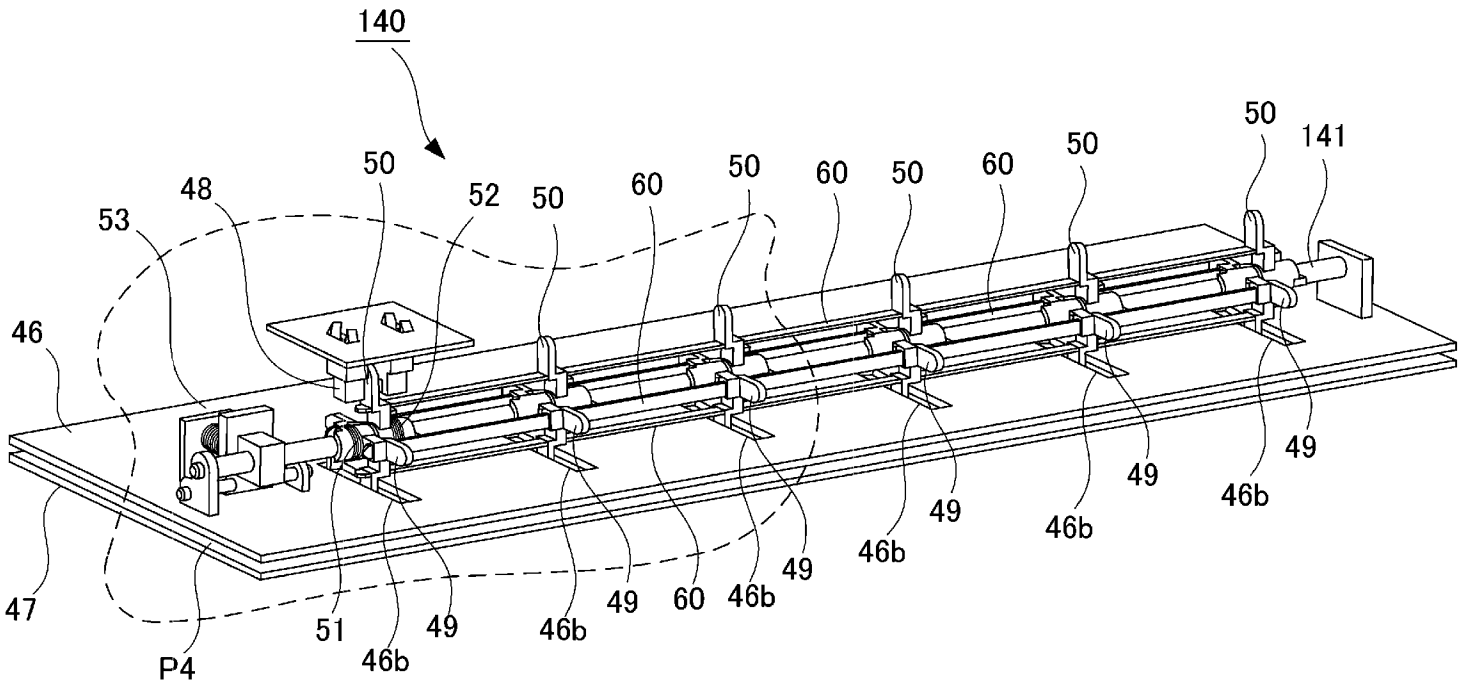
FIG. 9 is a first diagram describing a configuration of a sheet detecting apparatus provided in the sheet conveying apparatus.

In FIG. 8, a sheet detecting apparatus 140 is arranged on a sheet conveying path P4 between a conveying roller 22 that is a sheet conveying portion and a pair of registration rollers 23. The sheet detecting apparatus 140 includes six first sensor flags 49 and six second sensor flags 50 in an axial direction, as illustrated in FIG. 9. Note that, in FIG. 9, a connecting plate 60 that connects the plurality of first and second sensor flags 49 and 50, and by the connection of the first and second sensor flags 49 and 50, the first and second sensor flags 49 and 50 can be rotated at the same phase.

Here, as the connecting plate 60, a steel plate material having high rigidity is used so that the connected flags are not twisted in a rotating direction. However, a metal axis may be used instead of the steel plate. The connecting plate 60 is provided not to collide with a first conveying guide 46 when the first and second sensor flags 49 and 50 are rotated.

Note that, in the present embodiment, a rotation axis 41 has a length in the axial direction so as to support the six first and second sensor flags 49 and 50 in a rotatable manner. Slits 46*b* extending in a sheet conveying direction are formed in positions of the first conveying guide 46 and a second conveying guide 47, the positions facing the six first and second sensor flags 49 and 50. An optical sensor 48 is provided at a position corresponding to the first and second sensor flags 49 and 50 at a side of one side end of the rotation axis 41 in the present embodiment, which are one of the six first and second sensor flags 49 and 50.

Figure 10:
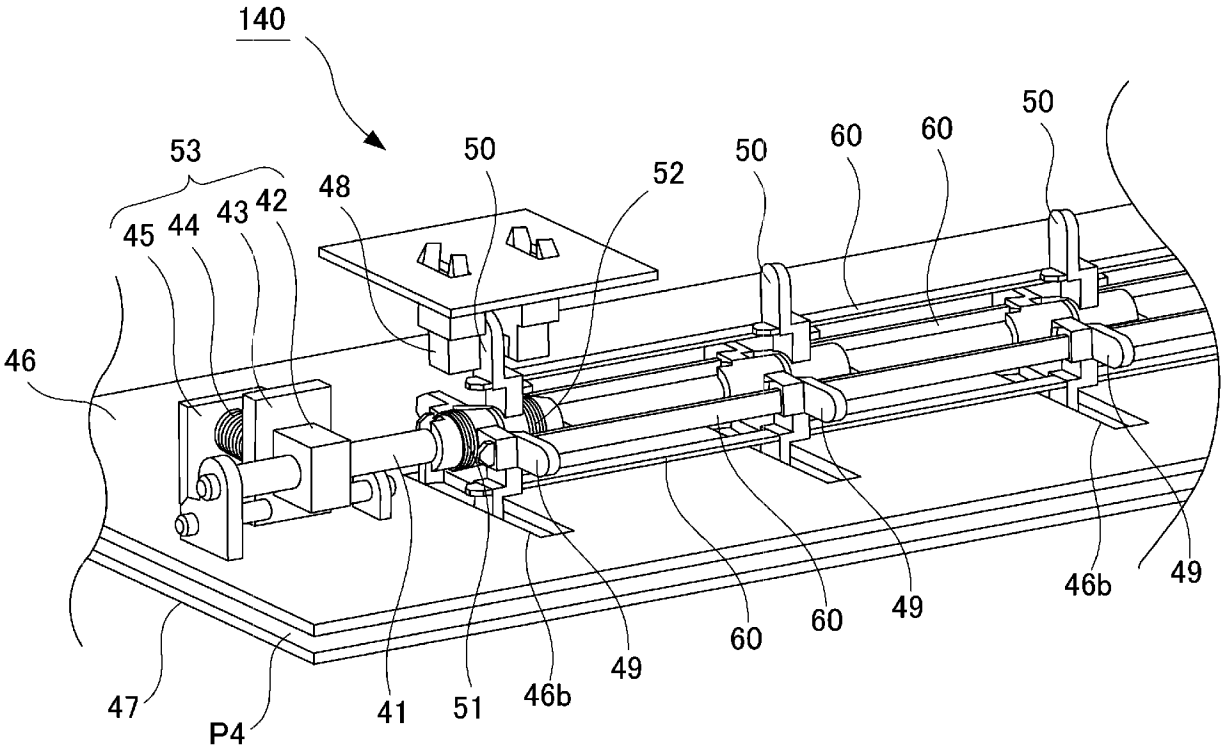
FIG. 10 is a second diagram describing a configuration of the sheet detecting apparatus.

Applied forces by torsion coil springs 51 and 52 are set to a pressure as small as possible within a limit in which the connected six first and second sensor flags 49 and 50 can follow the rotation of the rotation axis 41, that is, smaller than an applied force of a pressing spring 44 provided in a positioning mechanism 53. Further, in the present embodiment, as illustrated in FIG. 10, the positioning mechanism 53 for positioning the rotation axis 41 in the rotating direction in each ¼ round (90°) is provided at an end portion of the rotation axis 41. By the configuration of the sheet detecting apparatus 140, a similar effect to the first embodiment can be exerted.

Further, in the present embodiment, a conveyed sheet is caused to abut on the six first and second sensor flags 49 and 50 protruding into a sheet conveying path P4, so that skew feeding of the sheet is corrected. The magnitude of the applied force by the pressing spring 44 is set such that the correction of the skew feeding of the sheet by the first and second sensor flags 49 and 50 can be performed. To be specific, the magnitude of the applied force by the pressing spring 44 is set such that a tip end portion of the conveyed sheet is temporarily stopped by the first and second sensor flags 49 and 50, and the attitude of the skewed sent sheet is adjusted and the sheet is moved forward and backward.

As described above, in the present embodiment, the sheet detecting apparatus 140 includes the skew feeding correction function with respect to the conveyed sheet. Further, the sheet detecting apparatus 140 including the skew feeding correction function is provided at an upstream of a secondary transfer portion T as illustrated in FIG. 8, in the present embodiment. Accordingly, a toner image can be transferred to the sheet after the attitude of the sheet is adjusted, whereby the image can be accurately formed on the sheet.

Note that a case in which two lever portions are provided on the respective peripheral surfaces of the first and second sensor flags 49 and 50 has been described. However, the present invention is not limited thereto, and the same number of lever portions can be provided on the peripheral surfaces of the first and second sensor flags 49 and 50 with the same interval. That is, three or more lever portions can be provided on the peripheral surfaces of the first and second sensor flags 49 and 50.

Further, in the description of the embodiment, a configuration in which the first sensor flag 49 and the second sensor flag 50 are provided on the rotation axis 41 has been described. However, the present invention may have a configuration illustrated in FIG. 11.

In the configuration illustrated in FIG. 11, a rotation axis 141 includes a plurality of portions to be engaged 141*a*, 141*b*, and 141*c* that is integrally rotated with a rotation axis 141. Then, one rotating member 149 rotatable with respect to the rotation axis 141 is provided on the rotation axis 141. The rotating member 149 includes a plurality of sheet abutting portions 149*a*, 149*b*, and 149*c*, and engaging portions 149*d*, 149*e*, and 149*f* to be engaged with the plurality of portions to be engaged. Note that, as a mechanism that performs positioning of the rotation axis, a configuration similar to the above-described positioning mechanism 53 can be employed. Further, as a force applying member that elastically applies a force so that the rotating member can be rotated in a predetermined rotating direction, a configuration similar to the torsion coil spring 51 can be employed.

Figure 11A:
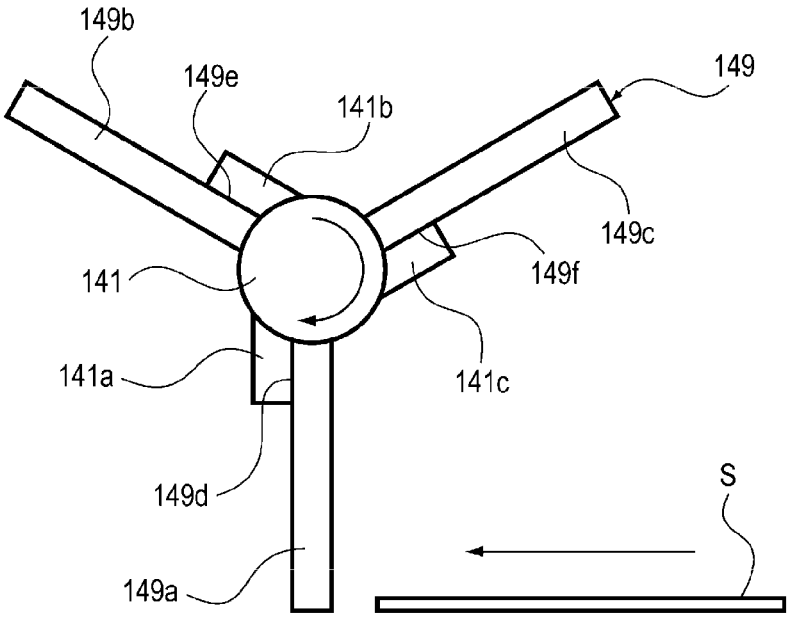
FIG. 11A to 11D are diagrams showing an alternate configuration illustrating the operation of the rotating member.

FIG. 11A illustrates a state in which the rotation axis 141 is positioned at a stop position by the positioning mechanism. The rotating member 149 receives an applied force by a torsion coil spring in a clockwise direction in FIG. 11. The engaging portion 149*d* of the rotating member 149 is stopped in a state of being engaged with the portion to be engaged 141*a* of the rotation axis 141.

Figure 11B:
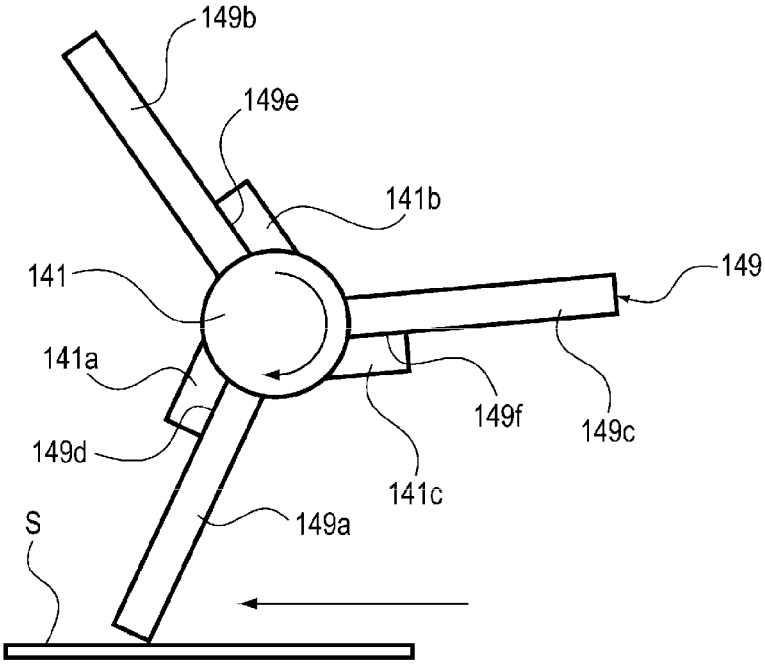
Figure 11C:
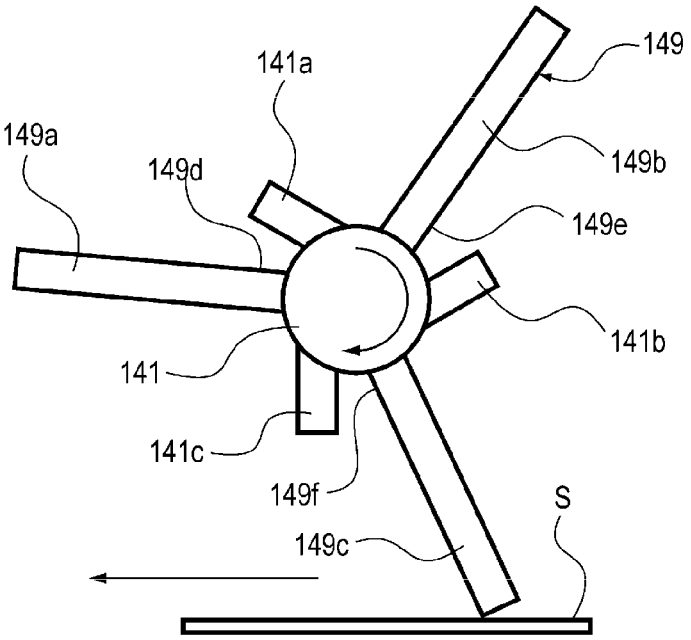

As illustrated in FIG. 11B, the sheet abutting portion 149*a* is pressed by the sheet S, so that the rotating member 149 is rotated. At this time, the engaging portion 149*d* is engaged with the portion to be engaged 141*a*, and thus the rotation axis 141 is rotated.

Figure 11D:
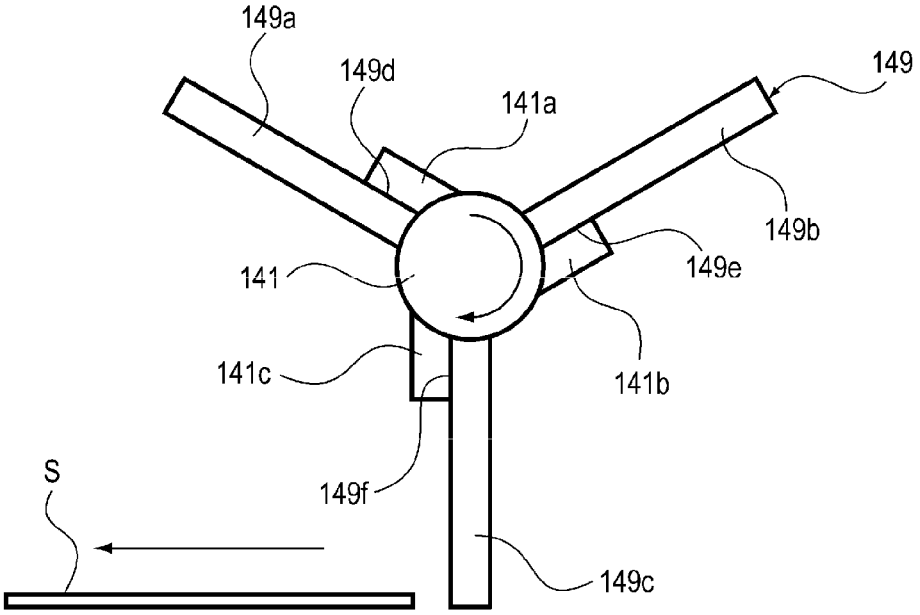

When the rotation axis 141 is rotated by a predetermined amount or more, the rotation axis 141 is rotated with respect to the rotating member 149 by the applied force of the positioning mechanism. Then, the rotation axis 141 is stopped at a stop position illustrated in FIG. 11C. Meanwhile, the rotation of the rotating member 149 is stopped in a state where the sheet abutting portion 149*c* is in contact with a surface of the sheet S. When a rear end of the sheet S has passed through the sheet abutting portion 149*c*, the rotating member 149 is rotated with respect to the rotation axis 141 by a small elastic force of the torsion coil spring 51 (a smaller elastic force than the applied force of the positioning mechanism). Then, as illustrated in FIG. 11D, the engaging portions 149*d*, 149*e*, and 149*f* are engaged with the portions to be engaged 141*a*, 141*b*, and 141*c*, so that the rotating member 149 is stopped.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-016881, filed Jan. 31, 2014, which is hereby incorporated by reference herein in its entirety.

What is claimed is:

1. A sheet conveying apparatus comprising:

a rotation axis rotatable in a predetermined rotating direction, and including a first portion to be engaged that is integrally rotated with the rotation axis, and a second portion to be engaged that is integrally rotated with the rotation axis;

a first rotating member including a first sheet abutting portion that is configured to abut on a conveyed sheet and a first engaging portion that is engaged with the first portion to be engaged, and rotatably provided on the rotation axis, the rotation axis being rotated in the predetermined rotating direction in a state where the first engaging portion and the first portion to be engaged are engaged, by the first rotating member being rotated in the predetermined rotating direction, by the first sheet abutting portion being pressed by the conveyed sheet;

a second rotating member including a second sheet abutting portion that is configured to abut on the conveyed sheet and a second engaging portion that is engaged with the second portion to be engaged, and rotatably provided on the rotation axis, the rotation axis being rotated in the predetermined rotating direction in a state where the second engaging portion and the second portion to be engaged are engaged, by the second rotating member being rotated in the predetermined rotating direction, by the second sheet abutting portion being pressed to the conveyed sheet;

a detector that is configured to detect that the sheet has passed through a sheet conveying path, according to movement of the first rotating member or the second rotating member;

a positioning unit that is configured to position the rotation axis to a stop position by rotating the rotation axis in the predetermined rotating direction;

a first force applying member that is configured to apply a force to the first rotating member to cause the first rotating member to be rotated in the predetermined rotating direction; and a second force applying member that is configured to apply a force to the second rotating member to cause the second rotating member to be rotated in the predetermined rotating direction, wherein in a case that the second rotating member engages with the second portion, the second rotating member rotates together with the first rotating member, and in a case that the second rotating member contacts with the conveyed sheet in a status that the rotation axis and the first rotating member are stopped by the positioning unit, contact status of the second rotating member with the conveyed sheet is cancelled as the conveyed sheet passes the second rotating member and the second rotating member rotates independently from the first rotating member by the second force applying member.

2. The sheet conveying apparatus according to claim 1, wherein the positioning unit causes the first engaging portion and the first portion to be engaged to be in an non-engaged state, by rotating the rotation axis in the predetermined rotating direction.

3. The sheet conveying apparatus according to claim 2, wherein the positioning unit causes the second engaging portion and the second portion to be engaged to be in an non-engaged state, by rotating the rotation axis in the predetermined rotating direction.

4. The sheet conveying apparatus according to claim 1, wherein, after a rear end of the conveyed sheet has passed through the first sheet abutting portion, the first rotating member is rotated with respect to the rotation axis by an applied force of the first force applying member.

5. The sheet conveying apparatus according to claim 4, wherein the first rotating member that is configured to receive the applied force of the first force applying member is stopped in a state where the first engaging portion is engaged with the first portion to be engaged.

6. The sheet conveying apparatus according to claim 1, wherein the first force applying member is a first elastic member that is configured to apply a force to the first rotating member by an elastic force.

7. The sheet conveying apparatus according to claim 6, wherein the positioning unit includes a cam that is integrally rotated with the rotation axis, a cam follower that is configured to follow the cam, and a cam force applying member.

8. The sheet conveying apparatus according to claim 7, wherein the elastic force of the first elastic member is smaller than an applied force of the cam force applying member.

9. The sheet conveying apparatus according to claim 1, wherein the detector detects the rear end of the conveyed sheet by rotating movement of the second rotating member rotated by the second force applying member.

10. The sheet conveying apparatus according to claim 1, wherein the detector detects the rear end of the conveyed sheet by rotating movement of the second rotating member rotated by the second sheet abutting portion.

11. The sheet conveying apparatus according to claim 1, wherein a contact portion between the rotation axis and the first rotating member is different from a contact portion between the rotation axis and the second rotating member in an axial direction of the rotation axis.

12. The sheet conveying apparatus according to claim 11, wherein the first force applying member, the first rotating member, the second rotating member and the second force applying member are aligned in this order in the axial direction of the rotation axis.

* * * * *